US012404127B2

(12) United States Patent
Noda et al.

(10) Patent No.: US 12,404,127 B2
(45) Date of Patent: Sep. 2, 2025

(54) IMAGE RECORDING APPARATUS AND FEED TRAY

(71) Applicant: BROTHER KOGYO KABUSHIKI KAISHA, Nagoya (JP)

(72) Inventors: Kengo Noda, Inazawa (JP); Nao Morimoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 133 days.

(21) Appl. No.: 18/150,312

(22) Filed: Jan. 5, 2023

(65) Prior Publication Data

US 2023/0242361 A1 Aug. 3, 2023

(30) Foreign Application Priority Data

Jan. 31, 2022 (JP) ..... 2022-012863

(51) Int. Cl.
*B65H 1/26* (2006.01)
*B65H 1/02* (2006.01)
(Continued)

(52) U.S. Cl.
CPC ..... *B65H 5/062* (2013.01); *B65H 1/027* (2013.01); *B65H 3/44* (2013.01); *B65H 7/02* (2013.01);
(Continued)

(58) Field of Classification Search
CPC ..... B65H 1/266; B65H 3/44; B65H 3/0684; B65H 16/08; B65H 1/04; B65H 2405/33;
(Continued)

(56) References Cited

U.S. PATENT DOCUMENTS 5,072,306 A 12/1991 Matsumoto et al.
2014/0291913 A1* 10/2014 Tamura ..... B65H 1/04 271/9.03
(Continued)

FOREIGN PATENT DOCUMENTS

JP H02264556 A 10/1990
JP H08169580 A 7/1996
(Continued)

*Primary Examiner* — Luis A Gonzalez
(74) *Attorney, Agent, or Firm* — Scully, Scott, Murphy & Presser, P.C.

(57) ABSTRACT

An image recording apparatus includes: a feed tray; a feed roller configured to feed a sheet medium accommodated in the feed tray; and a recording unit. The feed tray includes: a first accommodating part configured to accommodate a rolled body formed by rolling the sheet medium; a second accommodating part configured to accommodate a plurality of sheet media in a stacked state, each of the sheet media being the sheet medium; a contact surface configured to contact, from below, the sheet medium unrolled from the rolled body accommodated in the first accommodating part; and a support member having a support surface configured to support the sheet media accommodated in the second accommodating part. The feed roller is movable between a contact position at which the feed roller contacts the contact surface and a separation position at which the feed roller is away from the contact surface.

19 Claims, 12 Drawing Sheets

(51) Int. Cl.
*B65H 3/44* (2006.01)
*B65H 5/06* (2006.01)
*B65H 7/02* (2006.01)

(52) U.S. Cl.
CPC .. *B65H 2301/5111* (2013.01); *B65H 2402/30* (2013.01)

(58) Field of Classification Search
CPC ..... B65H 2405/331; B65H 2405/34; B65H 2405/40; B41J 11/58; B41J 11/48; B41J 11/485; B41J 15/044; B41J 11/50; G03G 15/6517
See application file for complete search history.

(56) References Cited

U.S. PATENT DOCUMENTS

2018/0282087 A1* 10/2018 Kanazawa ..... B41J 13/10
2022/0203716 A1* 6/2022 Noda ..... B41J 15/044

FOREIGN PATENT DOCUMENTS

JP 2003029480 A 1/2003
JP 2021035881 A * 3/2021

* cited by examiner

IMAGE RECORDING APPARATUS AND FEED TRAY

REFERENCE TO RELATED APPLICATIONS

This application claims priority from Japanese Patent Application No. 2022-012863 filed on Jan. 31, 2022. The entire content of the priority application is incorporated herein by reference.

BACKGROUND ART

Conventionally, there is known a facsimile machine (image recording apparatus) having a paper feed cassette (feed tray) capable of accommodating a rolled paper (rolled body) and cut papers (sheet media). This facsimile machine has a conveyance roller for feeding the rolled paper accommodated in the paper feed cassette from the paper feed cassette and a pick-up roller for feeding a sheet of cut paper accommodated in the paper feed cassette from the paper feed cassette.

DESCRIPTION

In the facsimile machine described above, the rolled paper and the cut papers accommodated in the paper feed cassette are fed from the paper feed cassette by separate rollers. In other words, the rolled paper and the cut papers accommodated in the paper feed cassette are fed from the paper feed cassette by separate paths. Therefore, the apparatus becomes larger.

An object of the present teaching is to provide an image recording apparatus and a feed tray capable of reducing the size of the apparatus.

According to a first aspect of the present teaching, there is provided an image recording apparatus, including:

a feed tray;

a feed roller configured to feed a sheet medium accommodated in the feed tray; and a recording unit configured to record an image on the sheet medium fed by the feed roller, wherein the feed tray includes:

a first accommodating part configured to accommodate a rolled body formed by rolling the sheet medium;

a second accommodating part configured to accommodate a plurality of sheet media in a stacked state, each of the sheet media being the sheet medium;

a contact surface configured to contact, from below, the sheet medium unrolled from the rolled body accommodated in the first accommodating part; and a support member having a support surface configured to support the sheet media accommodated in the second accommodating part, the feed roller is configured to be movable between a contact position at which the feed roller contacts the contact surface and a separation position at which the feed roller is away from the contact surface, and the support member is configured to be movable between a first position at which the support member is outside a movement path of the feed roller and a second position at which the support member is on the movement path of the feed roller with the support surface facing upward.

According to a second aspect of the present teaching, there is provided a feed tray, including;

a first accommodating part configured to accommodate a rolled body formed by rolling the sheet medium;

a second accommodating part configured to accommodate a plurality of sheet media in a stacked state, each of the sheet media being the sheet medium;

a roller configured to contact, from below, the sheet medium unrolled from the rolled body accommodated in the first accommodating part; and a support member having a support surface configured to support the sheet media accommodated in the second accommodating part, wherein the support member is configured to be movable between a cover position at which the support member covers the roller with the support surface facing upward and a separation position at which the support member is farther from the roller as compared with the cover position.

According to the image recording apparatus and feed tray of the present teaching, when feeding the sheet medium in the first accommodating part from the feed tray, the support member is set to the first position, so that the sheet medium in contact with the contact surface can be fed from the feed tray by the feed roller. When feeding the sheet medium in the second accommodating part from the feed tray, the supporting member is set to the second position, so that the sheet medium supported on the support surface can be fed from the feed tray by the feed roller. In other words, one feed roller can feed the sheet medium in the first accommodating part and the sheet medium in the second accommodating part from the feed tray along the same path. Therefore, the size of the apparatus can be reduced.

FIG. 8A depicts the flap in the first position, and FIG. 8B depicts the flap in the second position.

FIG. 10A depicts a state where no paper sheet is detected, and FIG. 10B depicts a state where a paper sheet is detected.

Figure 1:
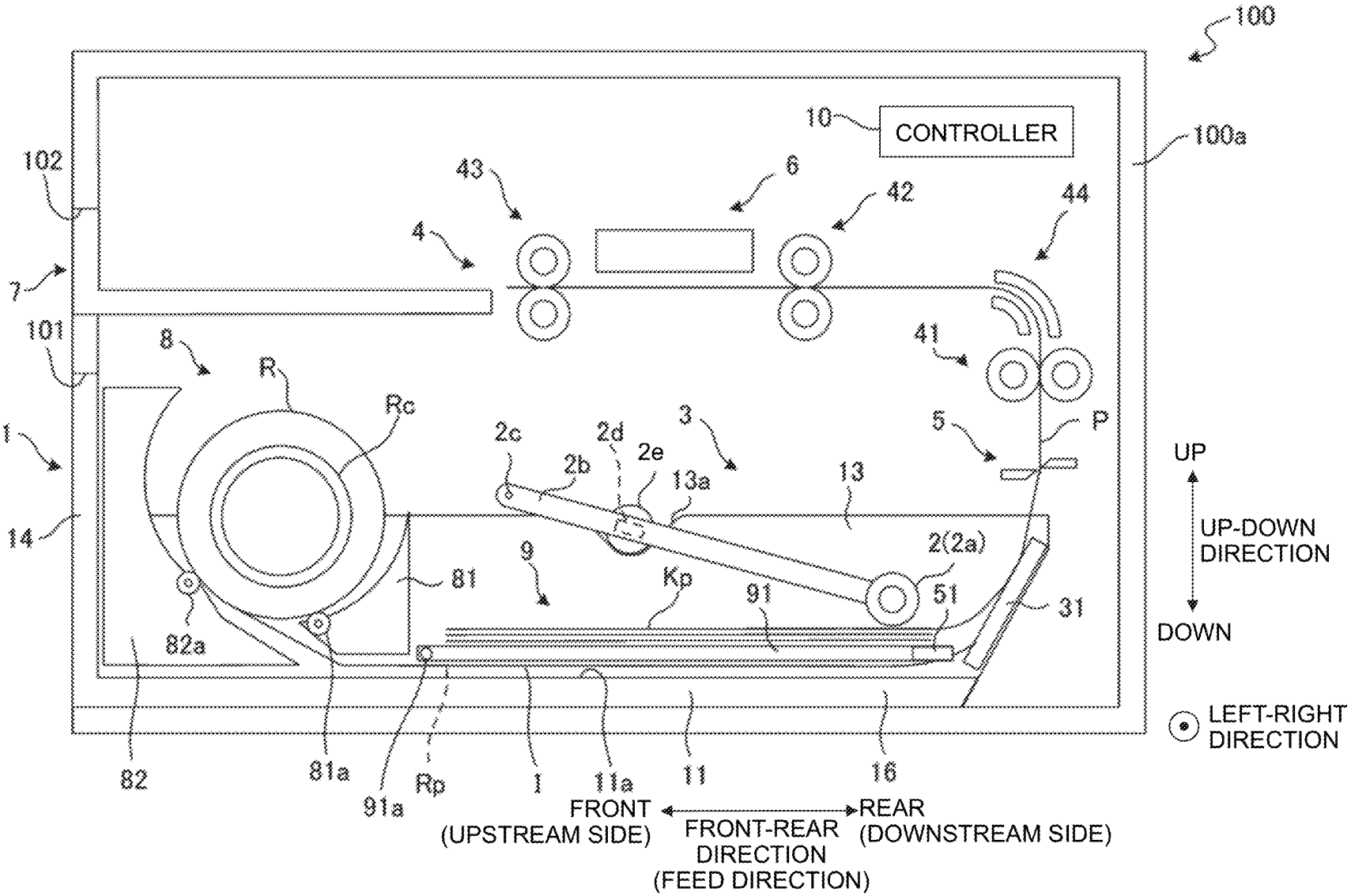
FIG. 1 is a schematic side view depicting an internal structure of a printer according to an embodiment of the teaching.

A printer 100 (image recording apparatus of the present teaching) according to one embodiment of the present teaching is described below with reference to FIG. 1. Up-down, front-rear, and left-right directions in FIG. 1 are defined as up-down, front-rear, and left-right directions of the printer 100, respectively.

(Overall Configuration of Printer 100)

The printer 100 mainly includes a housing 100*a*, a feed mechanism 3, a conveyance mechanism 4, a cutter 5, a head 6 (corresponding to the "recording unit" of the present teaching), a paper discharge tray 7, a paper sheet presence/absence detecting unit 20 (see FIG. 10) and a controller 10.

The feed mechanism 3 has a feed tray 1, a feed roller 2, and a separation strip 31. The feed tray 1 is located below the head 6 in a housing 100*a*. An opening 101 is formed in a front wall of the housing 100*a*. The feed tray 1 can be inserted into and removed from the housing 100*a* along the front-rear direction through the opening 101. In other words, the feed tray 1 can be moved along the front-rear direction between inside the housing 100*a* and outside the housing 100*a*.

The feed tray 1 can accommodate a rolled body R and cut papers Kp. The feed tray 1 has a first accommodating part 8 that can accommodate the rolled body R and a second accommodating part 9 that can accommodate a plurality of cut papers Kp (an example of the sheet media) in a stacked state. The rolled body R has a cylindrical core member Rc, and a rolled paper Rp (an example of the sheet medium) is rolled around an outer circumference of the cylindrical core member Rc. A width direction of the rolled paper Rp unrolled from the rolled body R in the feed tray 1 and a width direction of the cut papers Kp in the feed tray 1 coincide with the left-right direction.

In FIG. 1, both the rolled body R and the cut papers Kp are accommodated in the feed tray 1 for illustration. However, when recording images with the printer 100, any one of the rolled body R and the cut papers Kp is accommodated in the feed tray 1.

The feed roller 2 feeds the rolled paper Rp unrolled from the rolled body R accommodated in the first accommodating part 8 or a sheet of the cut papers Kp accommodated in the second accommodating part 9, from the feed tray 1. The rolled paper Rp and the cut paper Kp fed by the feed roller 2 are fed from feed tray 1 along the same path. In the following description, when the cut paper Kp and the rolled paper Rp are not distinguished, they are referred to as a "paper sheet P".

The feed roller 2 is configured with two rollers 2*a* supported on a tip end of an arm 2*b*. The two rollers 2*a* are arranged side by side along the left-right direction with the arm 2*b* intervening therebetween. The two rollers 2*a* are spaced apart from each other. The two rollers 2*a* rotate around an axis along the left-right direction by driving a feed motor not depicted in the figure.

The arm 2*b* is rotatably supported by a spindle 2*c*. The spindle 2*c* is supported by the housing 100*a*. The arm 2*b* is biased by an undepicted biasing member so that the feed roller 2 approaches a bottom surface 11*a* of the feed tray 1. The feed roller 2 is movable between a position at which the feed roller 2 contacts rollers 18 (see FIG. 2) arranged on the bottom surface 11*a* of the feed tray 1 and a position at which the feed roller 2 is away from the rollers 18, by a rotation of the arm 2*b* around the spindle 2*c*. As will be described in more detail later, the arm 2*b* can be retracted to a retracted position where the arm 2*b* does not interfere with the body portion 16 of the feed tray 1, in conjunction with a movement of the feed tray 1 from an inside of the housing 100*a* to an outside of the housing 100*a*.

When the feed motor is driven by the controller 10, the feed roller 2 rotates to apply conveying force in a direction from front to rear to the paper sheet P in contact with the feed roller 2. This causes the paper sheet P to be fed from the feed tray 1.

The separation strip 31 is provided to prevent feeding the cut papers Kp in a state of being overlapped with each other when feeding the cut papers Kp from the feed tray 1. The separation strip 31 is located downstream of the feed tray 1 in a feed direction (from front to rear; referred to simply as a "feed direction" in the following description).

The separation strip 31 is inclined so that a rear end is positioned higher than a front end. When the feed tray 1 is installed in the housing 100*a* and is inside the housing 100*a*, the separation strip 31 is positioned in a center of the feed tray 1 in the left-right direction. The separation strip 31 contacts a central part of the cut paper Kp in the width direction, and separates the cut paper Kp in contact with the feed roller 2 from the other sheets of the cut papers Kp in a stacked state. The paper sheet P fed from the feed tray 1 contacts the separation strip 31 and then is guided diagonally upward.

The conveyance mechanism 4 has an intermediate roller pair 41, a conveyance roller pair 42, a paper discharge roller pair 43, and a guide member 44. The intermediate roller pair 41 is configured by a drive roller which is rotated by driving of an undepicted intermediate motor, and a driven roller which is rotated along with the rotation of the drive roller. When the intermediate motor is driven by a control of the controller 10, the intermediate roller pair 41 rotates while nipping the paper sheet P to convey the paper sheet P. The intermediate roller pair 41 is located above the separation strip 31. The intermediate roller pair 41 conveys the paper sheet P which is fed from the feed tray 1 by the feed roller 2 and then guided diagonally upward by the separation strip 31 while nipping the paper sheet P. The guide member 44 is located above the intermediate roller pair 41. The guide member 44 guides the paper sheet P forward, after the paper sheet P has been conveyed upward by the intermediate roller pair 41.

The conveyance roller pair 42 is configured by a drive roller which is rotated by driving of an undepicted conveyance motor and a driven roller which is rotated along with the rotation of the drive roller. The paper discharge roller pair 43 is configured by a drive roller which is rotated by driving of an undepicted paper discharge motor and a driven roller which is rotated along with the rotation of the drive roller. When the conveyance motor and the paper discharge motor, which are not depicted in the figure, are driven by a control of the controller 10, the conveyance roller pair 42 and the paper discharge roller pair 43 rotate while nipping the paper sheet P to convey the paper sheet P. The conveyance roller pair 42 is located behind the head 6, and the paper discharge roller pair 43 is located in front of the head 6. The conveyance roller pair 42 conveys the paper sheet P forward while nipping the paper sheet P, after the paper sheet P has been guided forward by the guide member 44. The paper discharge roller pair 43 conveys the paper sheet P forward while nipping the paper sheet P, after the paper sheet P has been conveyed forward by the conveyance roller pair 42.

The cutter 5 is located between the separation strip 31 and the intermediate roller pair 41. The cutter 5 is configured, for example, by a disc-shaped rotating blade and a driven blade. The cutter 5 may also be configured by a rotating blade and a fixed blade. The rotating blade of the cutter 5 is rotated by driving of an undepicted cutting motor, and the cutter 5 reciprocates along the left-right direction. The rolled paper Rp unrolled from the rolled body R and conveyed is cut by the cutter 5 in the width direction of the rolled paper Rp by driving of the cutting motor under a control of the controller 10.

The head 6 includes a plurality of nozzles (not depicted) formed on a lower surface thereof and a driver IC (not depicted). The head 6 records an image on the paper sheet P, which is fed by the feed roller 2 from the feed tray 1, and conveyed by the conveyance mechanism 4. When the driver IC is driven by the controller 10, ink is ejected from the nozzles. When the paper sheet P conveyed by the conveyance mechanism 4 passes through an image recording position facing the lower surface of the head 6, the ink is ejected from the nozzles to form the image on the paper sheet P. The head 6 can be either a line type which ejects the ink from the nozzles in a state of the head 6 being fixed to a predetermined position or a serial type which ejects the ink from the nozzles while moving in the left-right direction.

The paper discharge tray 7 is located in front of the head 6 and above the feed tray 1 in the housing 100*a*. An opening 102 is formed in the front wall of the housing 100*a*. The paper discharge tray 7 can be inserted into and removed from the housing 100*a* along the front-rear direction through the opening 102. The paper discharge tray 7 receives the paper sheet P having the image formed by the head 6 and conveyed forward by the paper discharge roller pair 43.

The paper sheet presence/absence detecting unit 20 detects whether or not the paper sheet P is placed at a feed position where the feed roller 2 can feed the paper sheet P. In other words, the paper sheet presence/absence detecting unit 20 corresponds to the "detecting unit" of the present teaching. The paper sheet presence/absence detecting unit 20 is attached to the arm 2*b*, as depicted in FIG. 10. A specific configuration of the paper sheet presence/absence detecting unit 20 is described below.

The controller 10 is connected via an internal bus (not depicted) to the feed motor, the intermediate motor, the conveyance motor, the paper discharge motor, the cutting motor, the paper sheet presence/absence detecting unit 20, and the driver IC. The controller 10 includes a CPU (Central Processing Unit), a ROM (Read Only Memory) and a RAM (Random Access Memory). The ROM stores programs and data for the CPU to perform various controls. The RAM temporarily stores data used by the CPU to execute the programs.

In a case that the paper presence/absence detecting unit 20 detects that the paper sheet P is placed in the feed position, the controller 10 controls feed roller 2 to feed the paper sheet P from the feed tray 1.

(Configuration of Feed Tray 1)

Next, with further reference to FIGS. 2 to 8, the configuration of the feed tray 1 will be explained. In the following description, directions of each part of the feed tray 1 will be explained based on a posture of the feed tray 1 in a state where the feed tray 1 is installed in the housing 100*a*.

Figure 2:
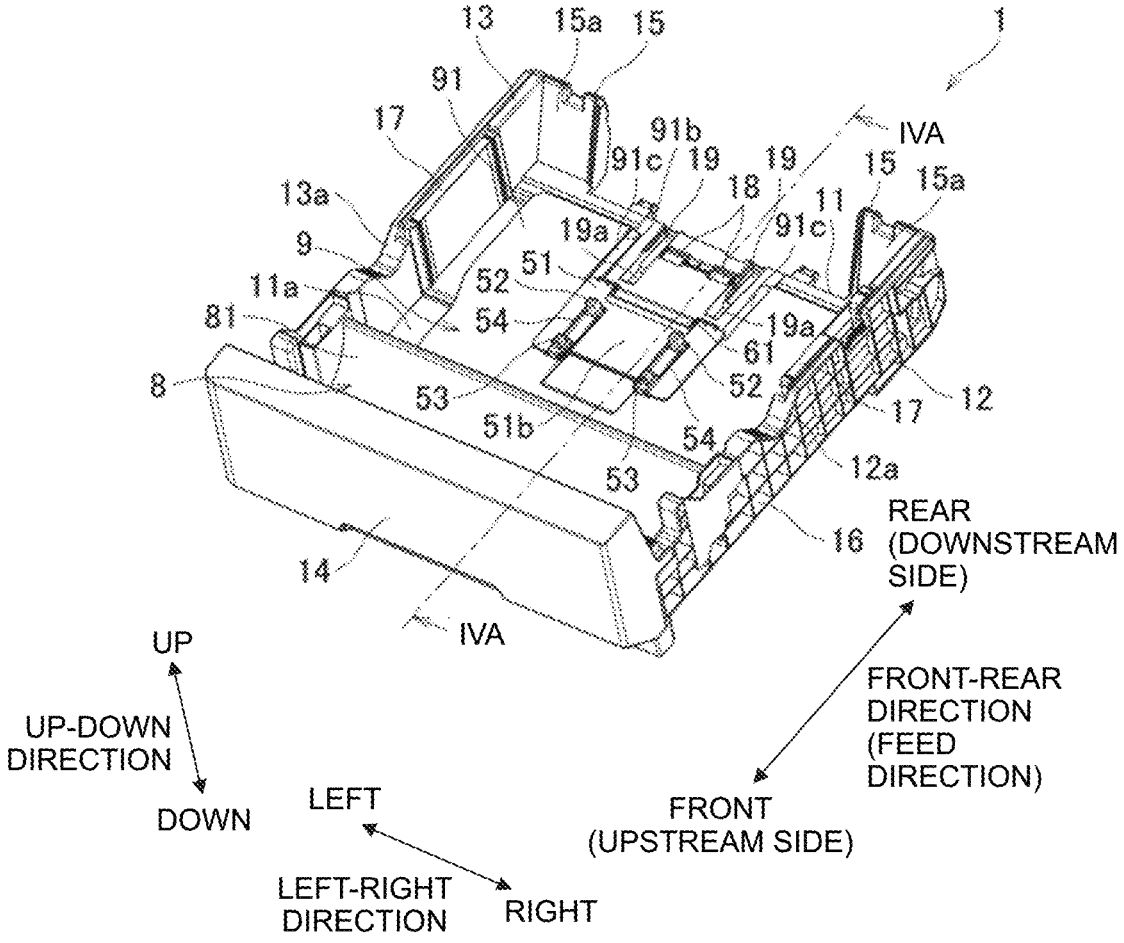
FIG. 2 is a perspective view of a feed tray depicted in FIG. 1, with a flap in a first position.
Figure 3:
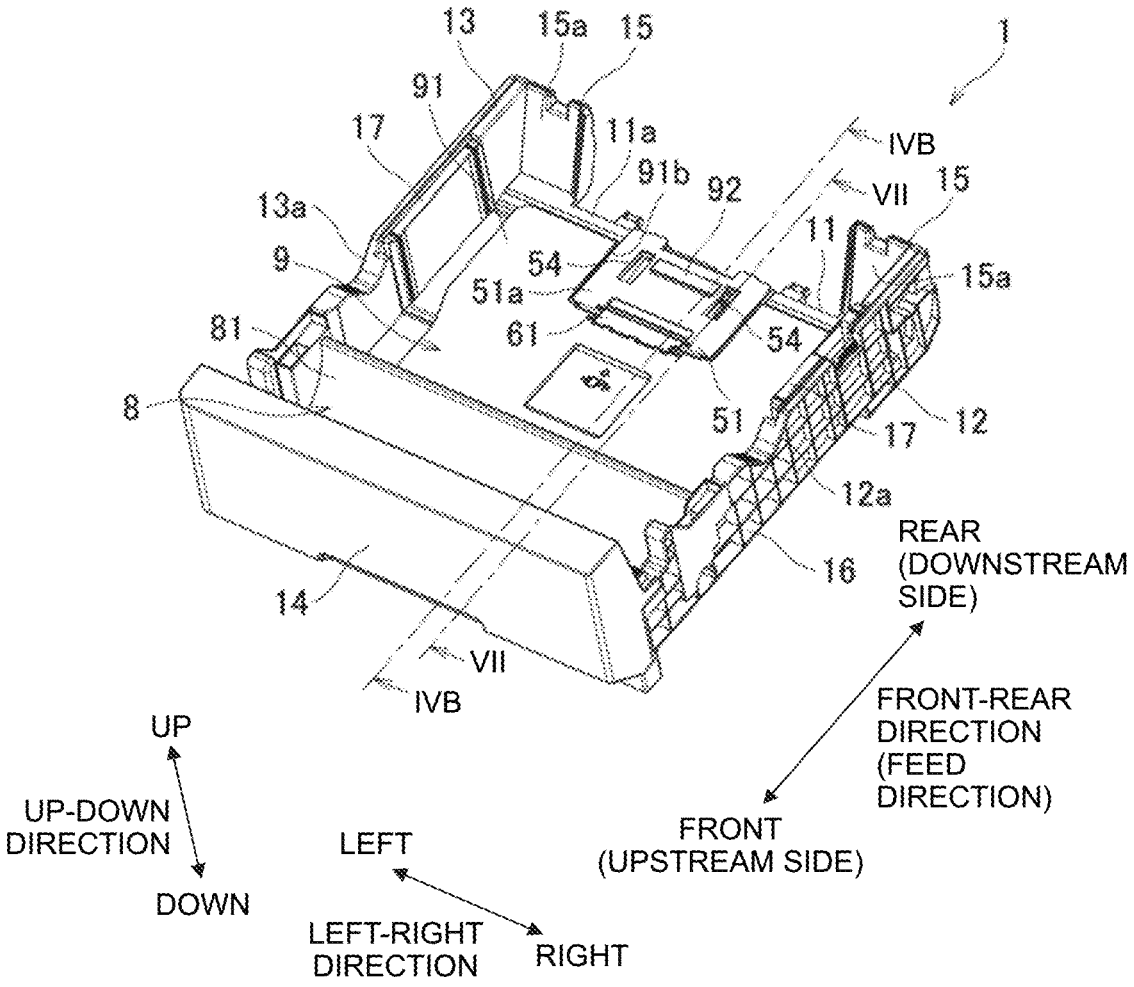
FIG. 3 is a perspective view of the feed tray depicted in FIG. 1, with the flap in a second position.

The feed tray 1 has a main body 16. As depicted in FIGS. 2 and 3, the main body 16 has a bottom wall 11 and side walls 12 to 15 at edges of the bottom wall 11, and is formed in a box shape with an upward opening.

The bottom wall 11 extends along a plane perpendicular to the up-down direction. An upper surface of the bottom wall 11 is the bottom surface 11*a* of the feed tray 1. The bottom surface 11*a* is orthogonal to the up-down direction. The side walls 12 and 13 extend upward from left and right end edges of the bottom wall 11. The side walls 12 and 13 also extend along the front-rear direction from a front end to a rear end of the bottom wall 11*a*. Notches 12*a* and 13*a* are formed at upper ends of the side walls 12 and 13, respectively. The side wall 14 extends upward from a front end edge of bottom wall 11. The side wall 14 extends along the left-right direction from a right end to a left end of the bottom wall 11.

Two side walls 15 are provided at a rear end edge of the bottom wall 11. The two side walls 15 are located at both ends in the left-right direction of the rear end edge of the bottom wall 11. Each of the sidewalls 15 has a guide surface 15*a* which is connected to a rear end of the bottom surface 11*a* and is inclined such that an upper end of the guide surface 15*a* is located behind a lower end of the guide surface 15*a*. When the feed tray 1 is installed in the housing 100*a*, the separation strip 31 (see FIG. 1) is positioned between the two side walls 15 arranged side by side in the left-right direction. The guide surface 15*a* of each of the side walls 15, together with the separation strip 31, guides the paper sheet P diagonally upward after the paper sheet P has been fed rearward by the feed roller 2.

The feed tray 1 has a pair of side guides 17 located inside the side walls 12 and 13. The side guides 17 are apart from each other in the left-right direction. The side guides 17 are supported by the bottom wall 11, such that the side guides 17 are movable in the left-right direction. The side guides 17 are arranged to face each other in the left-right direction. One side guide 17 and the other side guide 17 can be moved in tandem such that the side guides approach or are apart from each other by a known interlocking mechanism (not depicted) comprising, for example, racks facing each other and a pinion meshing with the racks.

As described above, the feed tray 1 has a first accommodating part 8 for accommodating the rolled body R and a second accommodating part 9 for accommodating a plurality of cut papers Kp in a stacked state. The first accommodating part 8 and the second accommodating part 9 are arranged along the feeding direction. The second accommodating part 9 is located downstream in the feeding direction of the first accommodating part 8.

The first accommodating part 8 accommodates the rolled body R such that an axial direction of the rolled body R coincides with the left-right directions. As depicted in FIG. 1, the first accommodating part 8 has two support stands 81 and 82, and two rollers 81*a* and 82*a*. The two support stands 81 and 82 are spaced apart from each other in the front-rear direction. The support stand 81 is located more rearward than the support stand 82. Each of the two support stands 81 and 82 extends along the left-right direction. The two rollers 81*a* and 82*a* are spaced apart from each other in the front-rear direction. The roller 81*a* is mounted on the support stand 81 to be rotatable around a rotation axis extending along the left-right direction. The roller 82*a* is mounted on the support stand 82 to be rotatable around a rotation axis extending along the left-right direction. The rollers 81*a* and 82*a* support the rolled body R from below in a state where the rollers 81*a* and 82*a* contact an outer circumferential surface of a lower portion of the rolled body R.

The rolled paper Rp drawn from the rolled body R accommodated in the first accommodating part 8 is drawn from a front side of the support stand 81 to a rear side of the support stand 81, through a gap between a lower surface of the support stand 81 and the bottom surface 11*a*.

The second accommodating part 9 has a support plate 91 for supporting, from below, the plurality of cut papers Kp in a stacked state. A rotation axis 91*a* (see FIG. 1) extending along the left-right direction is provided at a front end of the support plate 91. The support plate 91 is rotatable around the rotation axis 91*a*. The support plate 91 extends toward downstream side in the feed direction from the rotation axis 91*a* to a vicinity of a downstream end of the bottom wall 11 in the feed direction.

As depicted in FIG. 1, a feed path I of the rolled paper Rp, which has been unrolled from the rolled body R accommodated in the first compartment 8, is defined by the bottom wall 11 of the feed tray 1 and the support plate 91. The support plate 91 partitions an inner space of the feed tray 1 into a lower space as the feed path I for the rolled paper Rp and an upper space as the second accommodating part 9 for the plurality of cut papers Kp. Namely, the support plate 91 corresponds to the "partitioning member" of the present teaching.

The bottom surface 11*a* of the feed tray 1 supports the rolled paper Rp passing through the feed path I. As depicted in FIG. 2, the bottom surface 11*a* has two rollers 18 arranged side by side along the left-right direction. The bottom surface 11*a* and outer circumferential surfaces of the rollers 18 contact, from below, the rolled paper Rp passing through the feed path I. Namely, the bottom surface 11*a* and the outer circumferential surfaces of the rollers 18 correspond to the "contact surface" of the present teaching. The two rollers 18 are located in a central part in the left-right direction in a vicinity of a downstream end in the feed direction of the bottom surface 11*a*. The two rollers 2*a* configuring the feed roller 2 are contactable with the two rollers 18, respectively.

As depicted in FIG. 2, the bottom surface 11*a* of the feed tray 1 is formed with two grooves 19. The two grooves 19 are located on both sides of the two rollers 18 with respect to the left-right direction. Each groove 19 extends along the feed direction. A recess 19*a* is formed at an upstream end in the feed direction in the bottom of each groove 19.

As depicted in FIGS. 2 and 3, a notch 91*b* is formed at a downstream end in the feed direction of the support plate 91. The notch 91*b* is located in a central part in the left-right direction of the support plate 91. The notch 91*b* is located on a movement path of the feed roller 2, which moves from a position where the feed roller 2 contacts with the rollers 18 to a position where the feed roller 2 is separated from the rollers 18. The two rollers 18 and the two grooves 19 on the bottom surface 11*a* of the feed tray 1 are located inside the notch 91*b* of the support plate 91 in a top view. A flap 51 is attached to an inside of the notch 91*b* of the support plate 91, via a link member 61.

As depicted in FIG. 2, the support plate 91 has support portions 91*c* for supporting the flap 51 attached to the notch 91*b*. The support portions 91*c* are located at both edges in the left-right direction in the notch 91*b*. The support portions 91*c* support, from below, the flap 51 in a second position (see FIG. 3), as described below.

The flap 51 is a plate-shaped member. The flap 51 corresponds to the "support member" of the present teaching. One side of the flap 51 forms a support surface 51*a* for supporting the plurality of cut papers Kp accommodated in the second accommodating part 9.

Figure 4A:
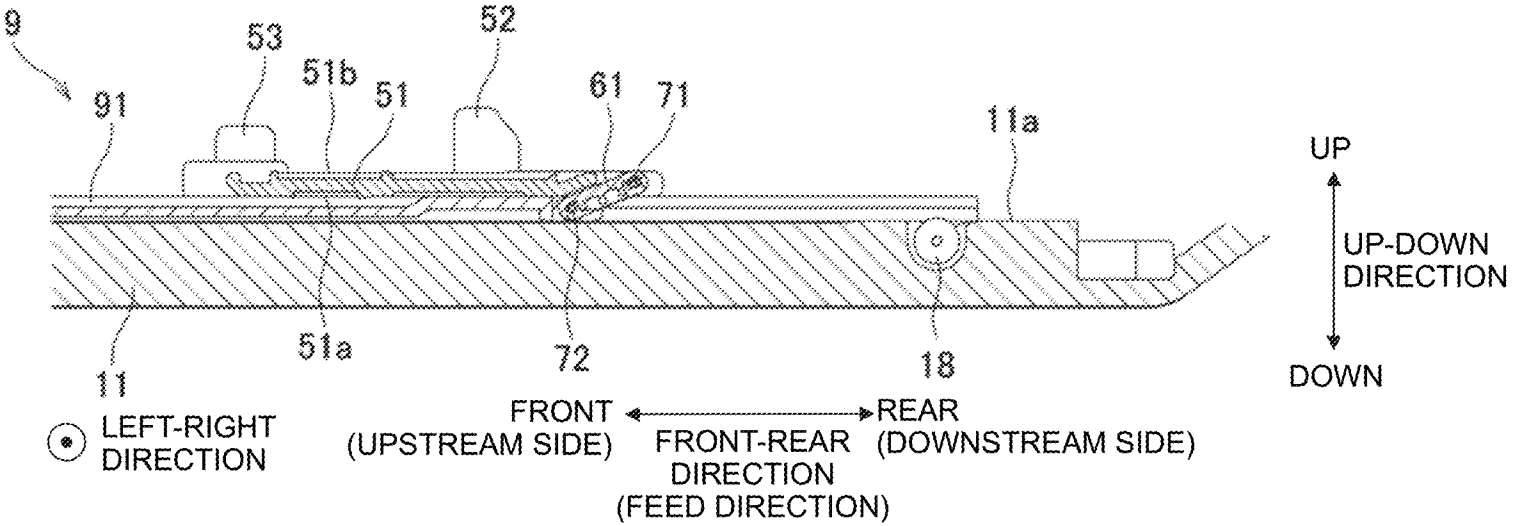
FIG. 4A is a cross-sectional view along a IVA-IVA line of the feed tray depicted in FIG. 2.
Figure 4B:
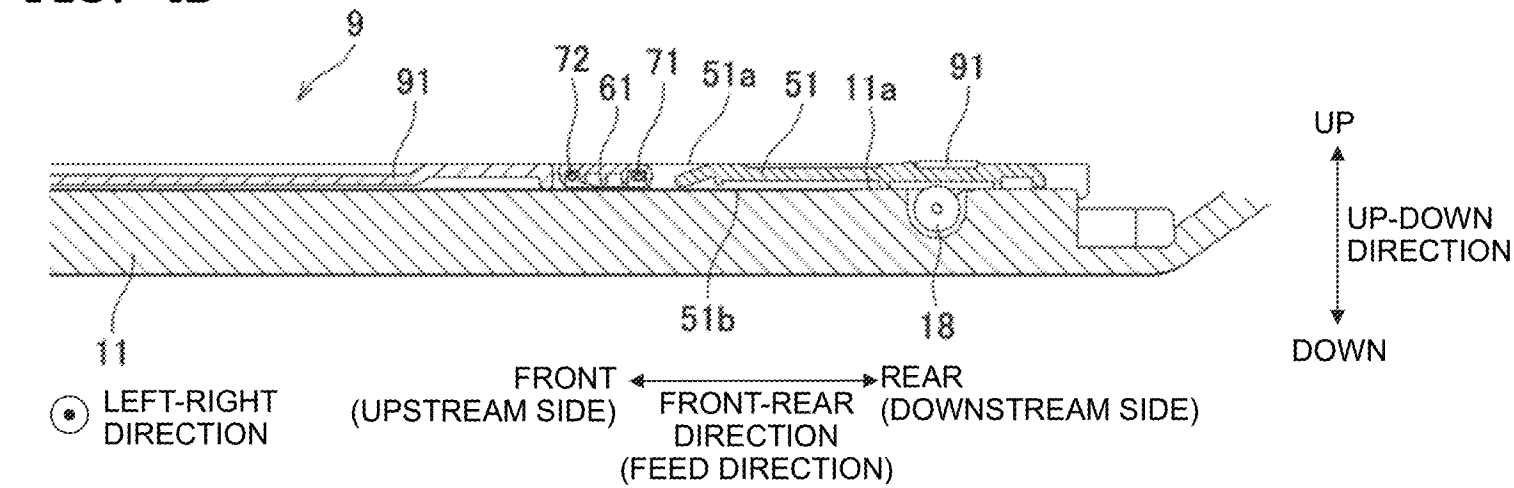
FIG. 4B is a cross-sectional view along a IVB-IVB line of the feed tray depicted in FIG. 3.

The flap 51 is configured to rotate about an axis 71 (corresponding to the "first axis" of the present teaching: see FIGS. 4A and 4B) extending in one direction in a plane parallel to the support surface 51*a*. By rotating about the axis 71, the flap 51 can be moved between a first position (see FIGS. 2 and 4A) and a second position (see FIGS. 3 and 4B). The first position is a position where the flap 51 is out of the movement path of the feed roller 2. The second position is a position where the flap 51 is on the movement path of the feed roller 2 with the support surface 51*a* facing upward. In a state that the flap 51 is in the second position, the flap 51 extends to a downstream side in the feed direction from the movement path of the feed roller 2. As depicted in FIG. 4B, when the flap 51 is in the second position, the flap 51 covers the rollers 18 provided on the bottom surface 11*a*.

When recording an image on the rolled paper Rp unrolled from the rolled body R accommodated in the first accommodating part 8, the flap 51 is positioned in the first position. When recording an image on a sheet of the cut paper Kp accommodated in the second accommodating unit 9, the flap 51 is positioned in the second position.

Figure 5:
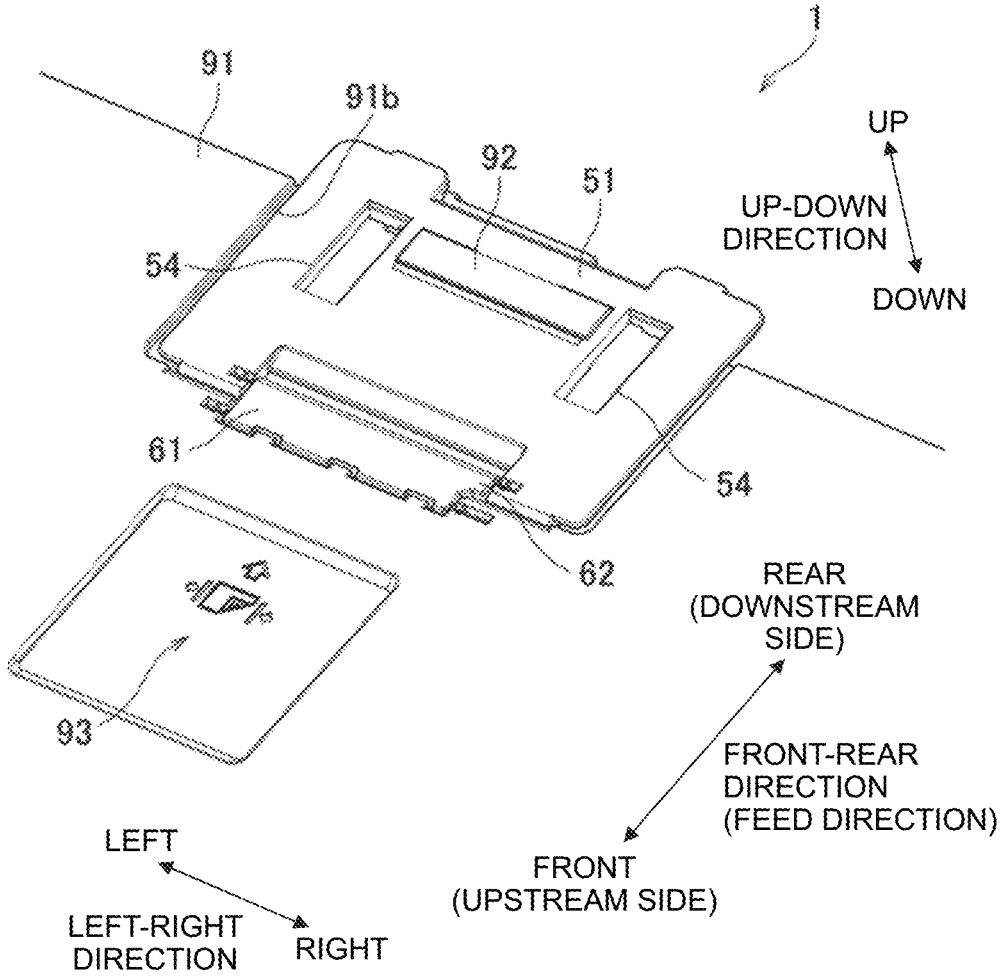
FIG. 5 is an enlarged view of an area near the flap depicted in FIG. 3.

As depicted in FIG. 5, the link member 61 is located between the flap 51 and the support plate 91 in the feed direction, in the state that the flap 51 is in the second position. The link member 61 is a plate-shaped member which is long in the left-right direction. One end in a short direction of the link member 61 is attached to the support plate 91, and the other end in the short direction of the link member 61 is attached to the flap 51. A length along the left-right direction of the link member 61 is shorter than a length along the left-right direction of the flap 51. The link member 61 has a protruding portion 62 protruding to the right at a right end of the other end in the short direction.

As depicted in FIG. 4B, the link member 61 is attached to the support plate 91, such that an upstream end in the feed direction of the link member 61 is rotatable around an axis 72 (corresponding to the "second axis" of the present teaching) extending along the left-right direction in the state that the flap 51 is in the second position.

As depicted in FIG. 4B, in the state that the flap 51 in the second position, the shaft 71 (corresponding to the "first axis" of the present teaching) described above is provided at a base end of the flap 51, which is an upstream end in the feed direction of the flap 51. In the state that the flap 51 is in the second position, the flap 51 is attached to a downstream end in the feed direction of the link member 61 to be rotatable around the axis 71. As depicted in FIG. 5, a central part in the left-right direction of the flap 51 is attached to the link member 61.

The flap 51 moves from the second position (see FIG. 4B) to the first position (see FIG. 4A), With the flap 51 in the second position, when the link member 61 rotates counterclockwise around the axis 72 and the flap 51 rotates counterclockwise around the axis 71. When the flap 51 is in the first position, the flap 51 is on the upper surface of the support plate 91 with the support surface 51*a* facing downward.

Figure 6:
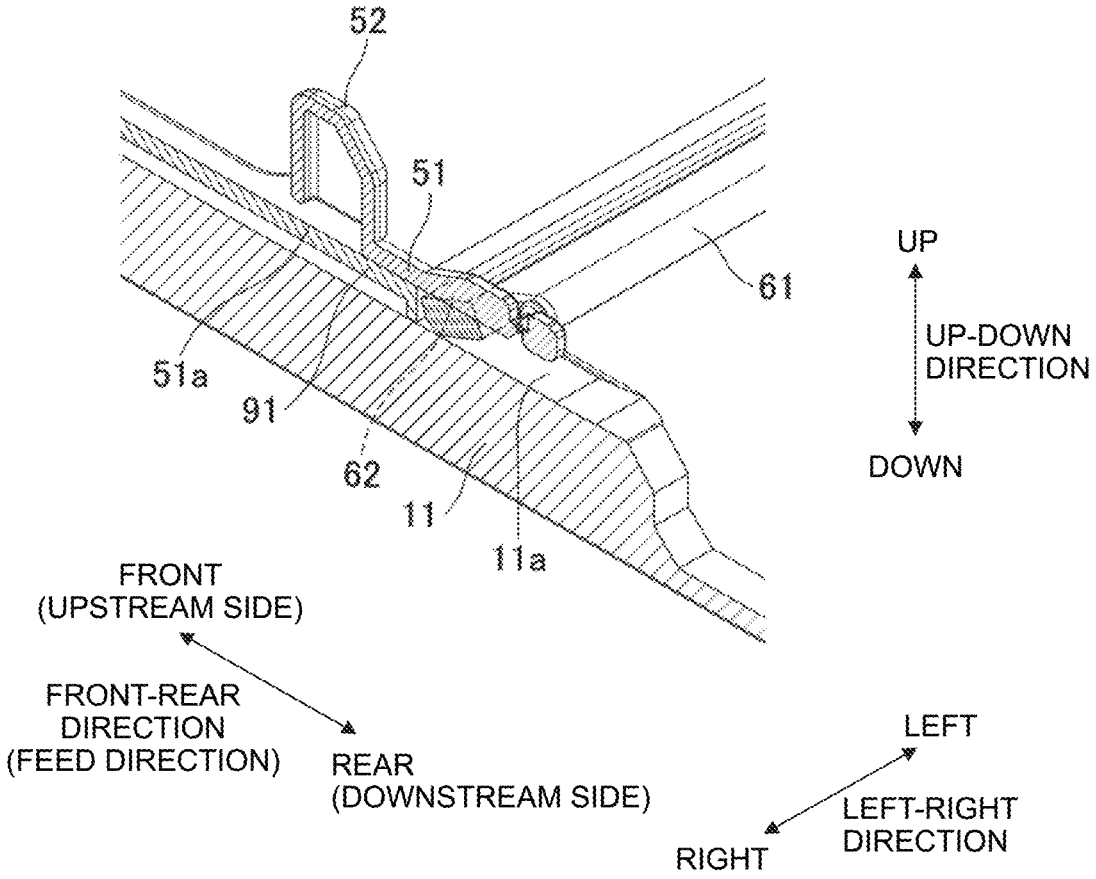
FIG. 6 is an enlarged view of an area near a protrusion in a link member when the flap is in the first position.

As depicted in FIG. 6, when the flap 51 moves from the second position to the first position, the protruding portion 62 of the link member 61 interferes with the support surface 51*a* of the flap 51. This prevents an angle between the bottom surface 11*a* of the feed tray 1 and the link member 61 from being 90 degrees or more. In other words, the protruding portion 62 of the link member 61 functions as the "regulating part" of the present teaching.

As depicted in FIG. 3, the support surface 51*a* of the flap 51 has a base pad 92. When the flap 51 is in the second position, a portion where the base pad 92 is provided is located on the movement path of the feed roller 2.

A coefficient of static friction of the base pad 92 is greater than a coefficient of static friction of the support surface 51*a*. In other words, in the support surface 51*a*, an area where the base pad 92 is not provided corresponds to the "first area" of the present teaching and the area where the base pad 92 is provided corresponds to the "second area" of the present teaching. The relationship of the coefficient of friction between the base pad 92 and the support surface 51*a* may be specified not only between the coefficients of static friction as in the present embodiment, but also between coefficients of dynamic friction. It may also be specified between a static friction coefficient of either one and a dynamic friction coefficient of the other.

As depicted in FIG. 2, the flap 51 has two first protrusions 52 on a surface 51*b* opposite to the support surface 51*a*. The two first protrusions 52 are separated from each other in the left-right direction.

As depicted in FIGS. 2 and 4A, in a state that the flap 51 is in the first position, the surface 51*b* faces upward. Thus, in the state that the flap 51 is in the first position, the first protrusions 52 project upward.

Figure 7:
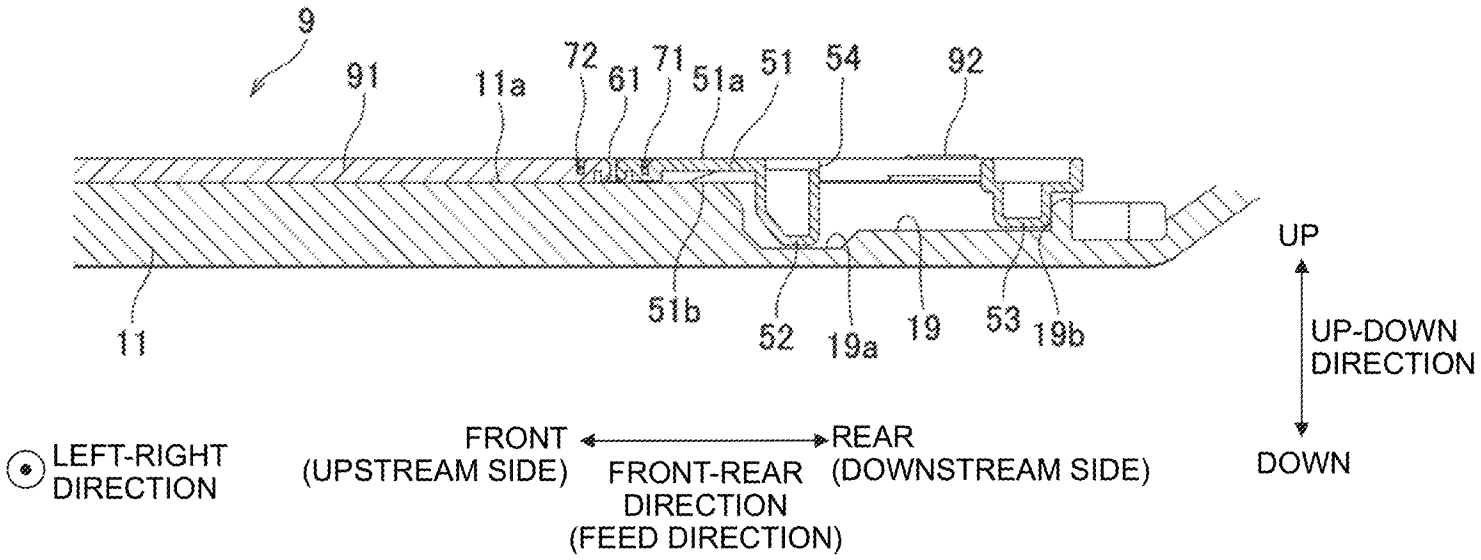
FIG. 7 is a cross-sectional view along a VII-VII line of the feed tray depicted in FIG. 3.

As depicted in FIG. 7, when the flap 51 is in the second position, the face 51*b* faces downward. Thus, when the flap 51 is in the second position, the two first protrusions 52 project downward. When the flap 51 is in the second position, the two first protrusions 52 are received in the recesses 19*a* of the two grooves 19, respectively. As depicted in FIG. 7, with the flap 51 in the second position, an upstream part in the feed direction of the tip of each first protrusion 52 is chamfered.

As depicted in FIG. 2, the two recesses 19*a* for receiving the two first protrusions 52 respectively are located between the first accommodating part 8 and the two rollers 18 arranged on the bottom surface 11*a*, with respect to the feed direction. That is, when the flap 51 is in the second position, the two first protrusions 52 are positioned between the first accommodating part 8 and the two rollers 18 arranged on the bottom surface 11*a*. The first protrusions 52 are positioned at positions where the first protrusions 52 prevent the rolled paper Rp unrolled from the rolled body R accommodated in the first accommodating part 8 from proceeding toward the rollers 18.

As depicted in FIG. 2, two second protrusions 53 are formed on the surface 51*b* of the flap 51. The two second protrusions 53 are spaced apart from each other in the left-right direction. The two second protrusions 53 are provided in line with the two first protrusions 52 along the feed direction. As depicted in FIG. 7, the second protrusions 53 are provided in a vicinity of an end opposite to the base end of the flap 51, with respect to a direction perpendicular to the left-right direction. When the flap 51 is in the second position, the two second protrusions 53 are received in the two grooves 19 formed in the bottom surface 11*a*. A downstream side wall in the feed direction of each groove 19 is an abutment surface 19*b*, against which corresponding second protrusion 53 abut. The abutment surface 19*b* faces upstream in the feed direction.

The flap 51 has two openings 54, as depicted in FIG. 2. Each opening 54 extends along the feed direction. The two openings 54 are located between the two first protrusions 52 and the two second protrusions 53 arranged in the feed direction. As depicted in FIG. 3, with the flap 51 in the second position, downstream ends in the feed direction of the openings 54 are located on both sides of the base pad 92 with respect to the left-right direction.

Figure 8A:
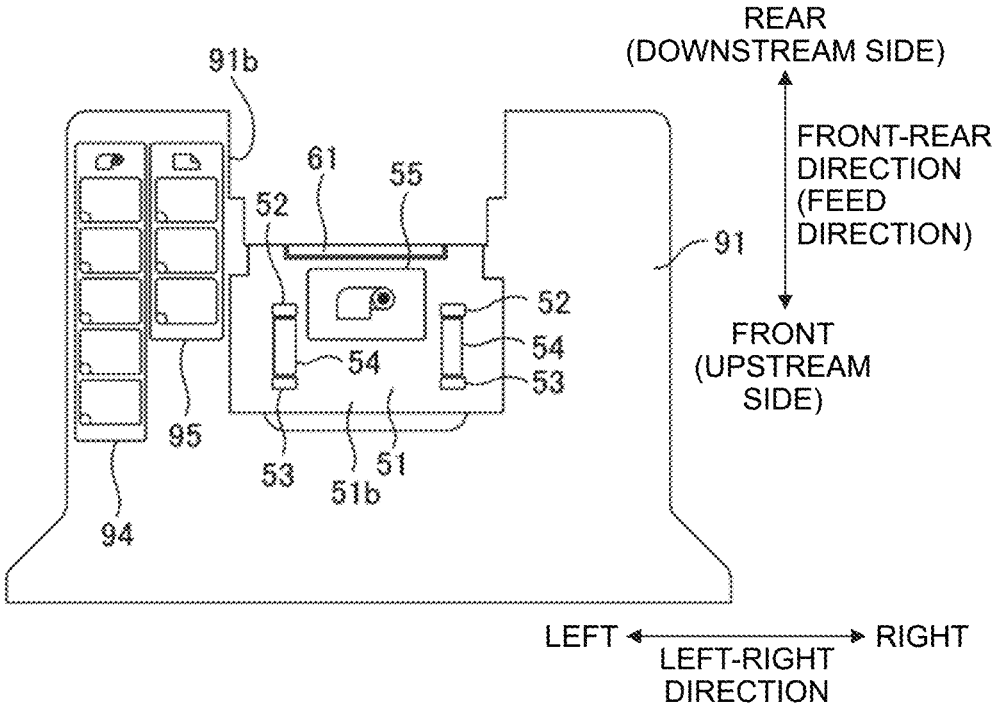
FIGS. 8A and 8B depict a support plate and a display on the flap.

As depicted in FIG. 8A, a rolled paper label 55, which informs the user that the rolled paper Rp is to be set, is attached to the surface 51*b* facing upward with the flap 51 in the first position. The rolled paper label 55 has an illustration of the rolled body R.

Figure 8B:
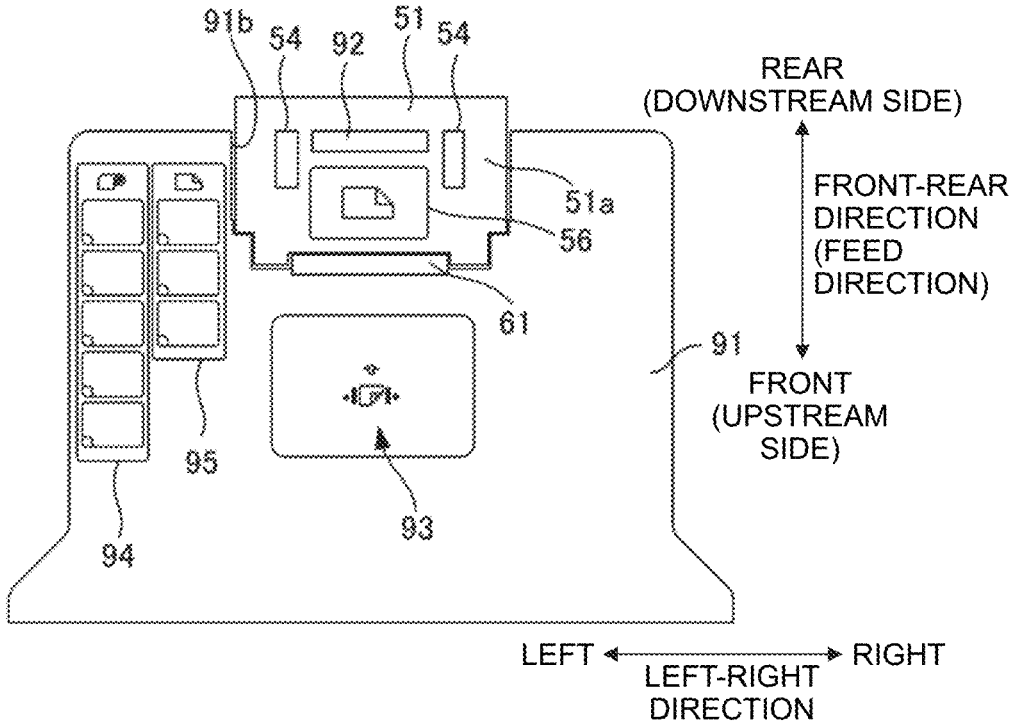

As depicted in FIG. 8B, a cut paper label 56, which informs the user that the cut papers Kp are to be set, is attached to the support surface 51*a* facing upward with the flap 51 in the second position. The cut paper label 56 has an illustration of the cut paper Kp.

As depicted in FIG. 8B, a mark 93 indicating an orientation of the cut paper Kp to be set, etc. is depicted on the upper surface of the support plate 91. As depicted in FIG. 8A, when the flap 51 is in the first position, the mark 93 is covered by the flap 51.

Figure 9:
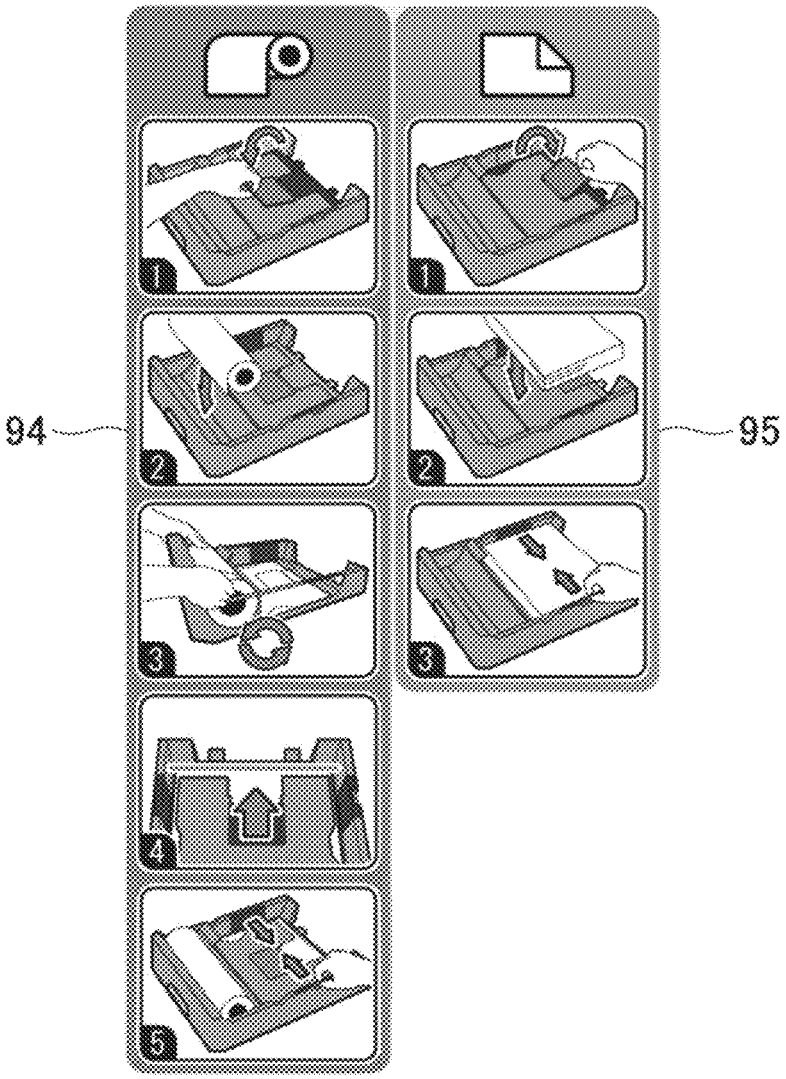
FIG. 9 is an enlarged view of a rolled paper setting procedure label and a cut paper setting procedure label.

A rolled paper setting procedure label 94 and a cut paper setting procedure label 95 are attached to the upper surface of the support plate 91. The rolled paper setting procedure label 94 informs the user of a procedure for setting the rolled paper Rp and the cut paper setting procedure label 95 informs the user of a procedure for setting the cut papers Kp. As depicted in FIG. 9, the rolled paper setting procedure label 94 has an illustration illustrating the procedure for setting rolled paper Rp. The cut paper setting procedure label 95 has an illustration illustrating the procedure for setting cut papers Kp.

A color of a background of the rolled paper label 55 and a color of a background of the rolled paper setting procedure label 94 are the same color. A color of a background of the cut paper label 56 and a color of a background of the cut paper setting procedure label 95 are the same color. The color of the background of the rolled paper label 55 and the rolled paper setting procedure label 94 and the color of the background of cut paper label 56 and the cut paper setting procedure label 95 are different from each other. For example, the background color of the rolled paper label 55 and the rolled paper setting procedure label 94 is blue, while the background color of the cut paper label 56 and the cut paper setting procedure label 95 is green. This allows the user to easily distinguish whether the label is informing matters related to the rolled paper Rp or the cut paper Kp.

(Configuration of Paper Sheet Presence/Absence Detecting Unit 20)

Figure 10A:
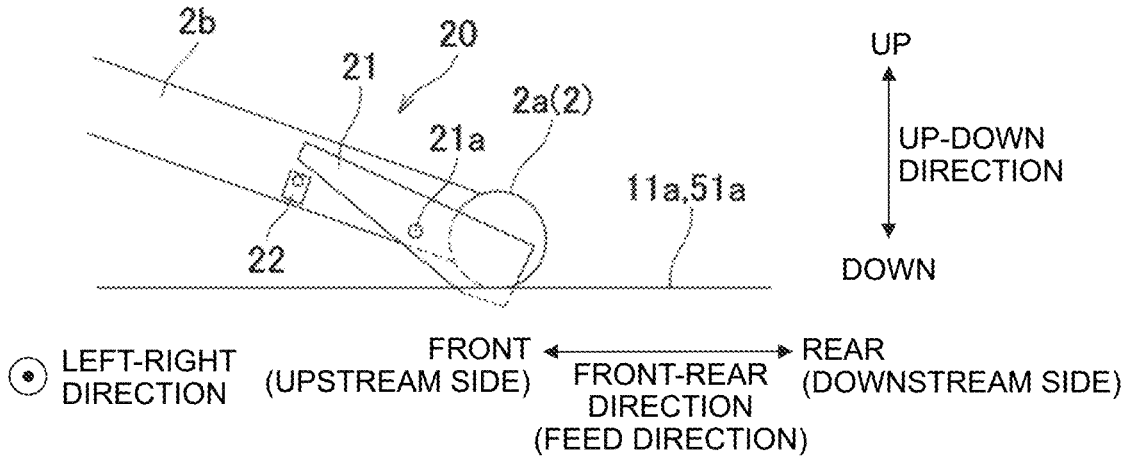
FIGS. 10A and 10B illustrate configurations of a paper sheet presence/absence detecting unit.
Figure 10B:
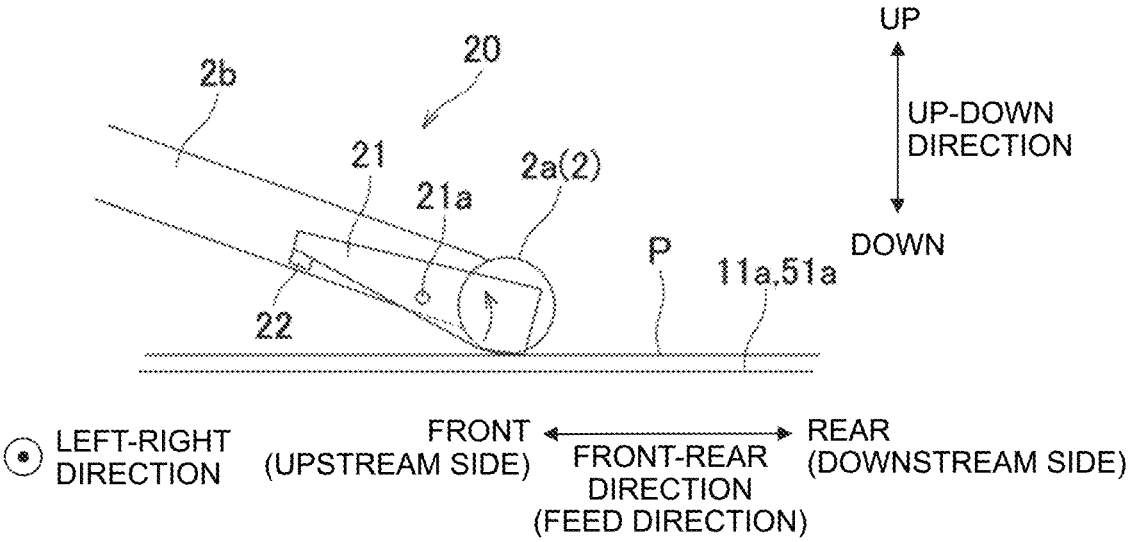

Referring to FIGS. 10A and 10B, a configuration of the paper sheet presence/absence detecting unit 20 is described. The paper sheet presence/absence detecting unit 20 includes an actuator 21 and a sensor 22. Actuator 21 is supported by the arm 2*b* to be rotatable around a rotation axis 21*a*. An axial direction of the rotation axis 21*a* is parallel to the left-right direction. The sensor 22 is a sensor that detects the actuator 21. The sensor 22 is attached to the arm 2*b*. The sensor 22 is, for example, a photo sensor having a light emitting element and a light receiving element (not depicted). The actuator 21 is biased by a force member (not depicted) in a clockwise direction in FIGS. 10A and 10B. As depicted in FIG. 10A, when no external force is applied to the actuator 21, one end of the actuator 21 (the right end in FIG. 10A) is positioned below the lower end of feed roller 2. At this time, the other end of the actuator 21 (left end in FIG. 10A) does not block an optical path of the sensor 22.

As depicted in FIG. 10A, when the feed roller 2 contacts the rollers 18 in a state that the rolled paper Rp is not in a feed position (in a state that the rolled paper Rp is not in a position, in the bottom surface 11*a*, where the rollers 18 are not provided) one end of the actuator 21 is located inside the groove 19 and below the lower end of the feed roller 2. Namely, the other end of the actuator 21 does not block the optical path of the sensor 22.

On the other hand, when the feed roller 2 and the rollers 18 nip the rolled paper Rp therebetween in a state that the rolled paper Rp is in the feed position (in a state that the rolled paper Rp is in the position, in the bottom surface 11*a*, where the rollers 18 are provided), the one end of the actuator 21 contacts the rolled paper Rp. As a result, the one end of the actuator 21 is pushed upward by the rolled paper Rp, and the actuator 21 rotates counterclockwise around the rotation axis 21*a*, as depicted in FIG. 10B. At this time, the other end of the actuator 21 blocks the optical path of the sensor 22. This allows the paper sheet presence/absence detecting unit 20 to detect that the paper sheet P is positioned at the feed position of the feed roller 2.

When the feed roller 2 contacts the base pad 92 in a state that the cut paper Kp is not in the feed position (in a state that the cut paper Kp is not in a position, in the support surface 51*a*, where the base pad 92 is provided), as depicted in FIG. 10A, one end of the actuator 21 is located inside the opening 54 and below the lower end of the feed roller 2. Namely, the other end of the actuator 21 does not block the optical path of the sensor 22.

On the other hand, when the feed roller 2 contacts the cut paper Kp in a state that the cut paper Kp is in the feed position (in a state that the cut paper Kp is in the position, in the support surface 51*a*, where the base pad 92 is provided), the one end of the actuator 21 also contacts the cut paper Kp. As a result, the one end of the actuator 21 is pushed upward by the cut paper Kp, and the actuator 21 is rotated counterclockwise around the rotation axis 21*a*, as depicted in FIG. 10B. At this time, the other end of the actuator 21 blocks the optical path of the sensor 22. This allows the paper sheet presence/absence detecting unit 20 to detect that the paper sheet P is positioned at the feed position of the feed roller 2.

(Retraction Mechanism of Arm 2*b*)

Figure 11:
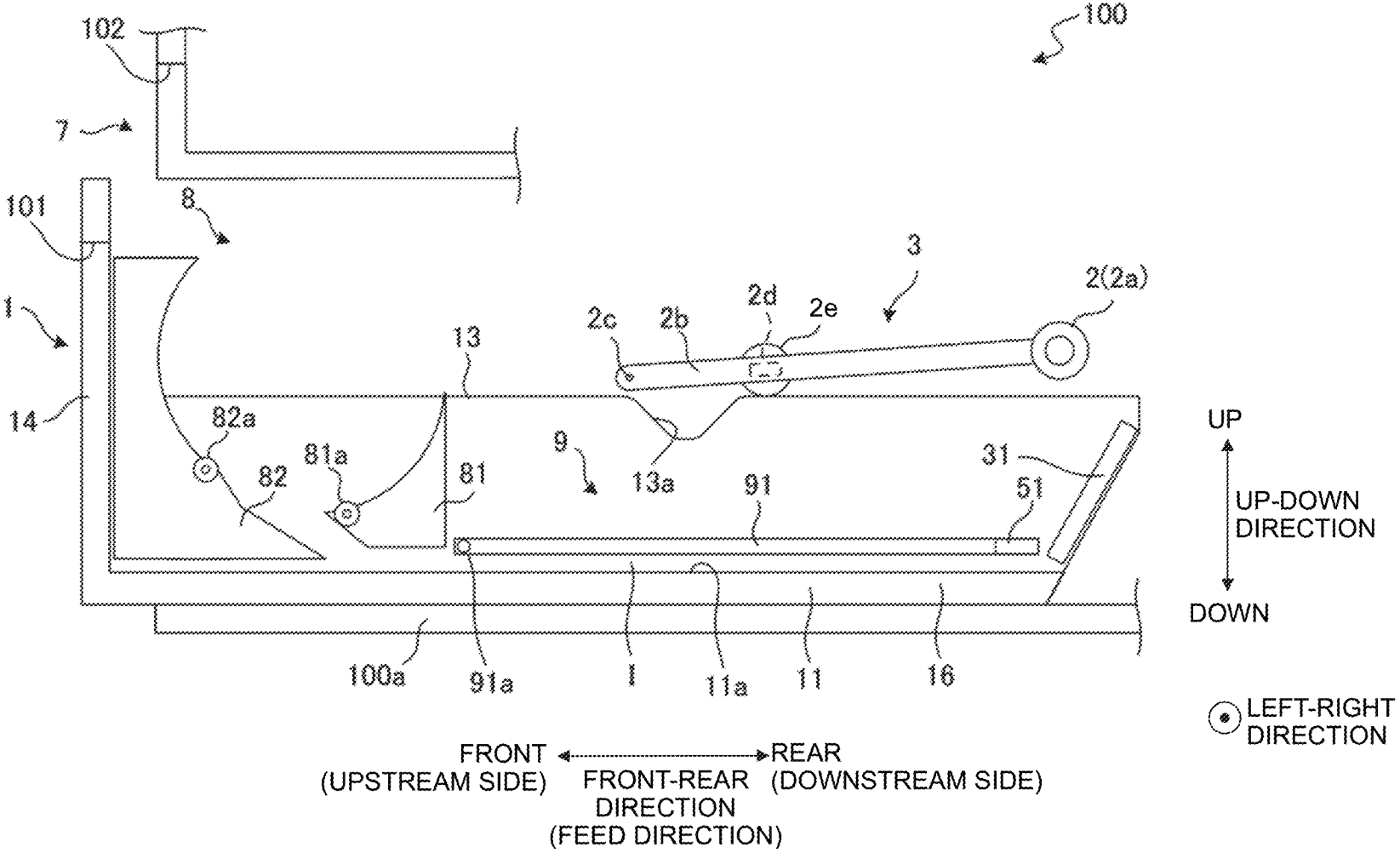
FIG. 11 depicts a state where an arm supporting a feed roller is in a retracted position.

A retraction mechanism of feed roller 2 will be described with reference to FIG. 11. As depicted in FIGS. 1 and 11, the arm 2*b* of the feed roller 2 has an extending portion 2*d* extending along the left-right direction. A roller 2*e* is attached to an end in the left-right direction of the extending portion 2*d* to be rotatable around a rotation axis extending along the left-right direction. As depicted in FIG. 1, when the feed tray 1 is inside the housing 100*a*, the feed roller 2 is in the feed position. At this time, the roller 2*e* is in a notch 13*a* (notch 12*a*) formed in the side wall 13 (side wall 12).

As the feed tray 1 is pulled out from inside the housing 100*a* and moves frontward, as depicted in FIG. 11, the roller 2*e* rolls to an upper surface of the side wall 13 (side wall 12) over the notch 13*a* (notch 12*a*). As a result, the arm 2*b* pivots upward around the spindle 2*c*, and the arm 2*b* moves to the retracted position.

(Procedure for Setting Rolled Paper Rp and Cut Paper Kp)

When recording images on the rolled paper Rp, the rolled body R is accommodated in the first accommodating part 8 of the feed tray 1. At this time, the flap 51 is set to the first position. Then, the rolled paper Rp unrolled from the rolled body R is fed to the downstream side in the feed direction from the rollers 18. In this state, the feed tray 1 is moved from outside of the housing 100*a* to inside of the housing 100*a*. As a result, the feed roller 2 and the rollers 18 nip the rolled paper Rp and make it possible to feed the rolled paper Rp.

When recording images on the cut papers Kp, the flap 51 is set to the second position and the cut papers Kp are accommodated in the second accommodating part of feed tray 1 in a stacked state. As a result, the support surface 51*a* of the flap 51 supports the cut papers Kp. In this state, the feed tray 1 is moved from the outside of the housing 100*a* to the inside of the housing 100*a*. As a result, the feed roller 2 contacts the uppermost cut paper Kp of the cut papers Kp and makes it possible to feed the cut paper Kp.

Features of the Embodiment

As described above, the printer 100 in this embodiment includes the feed tray 1, the feed roller 2 which can feed the paper sheets P accommodated in the feed tray 1, and a head 6 which records images on the paper sheet P fed by the feed roller 2. The feed tray 1 has the first accommodating part 8 for accommodating the rolled body R in which the paper sheet P is rolled, the second accommodating part 9 for accommodating the cut papers Kp in a stacked state, the rollers 18 which contact, from below, the paper sheet P unrolled from the rolled body, and the flap 51 having the support surface 51*a* for supporting the cut papers Kp accommodated in the second accommodating part 9. The feed roller 2 is configured to move between the position where the feed roller 2 contacts with the rollers 18 and the position where the feed roller 2 is away from the rollers 18. The flap 51 is configured to be movable between the first position where the flap 51 is retracted from (out of) the movement path of the feed roller 2 and the second position where the flap 51 is positioned on the movement path of the feed roller 2 with the support surface 51*a* facing upward.

With the above configuration, when feeding the rolled paper Rp from the first accommodating part 8 of the feed tray 1, the flap 51 is set to the 1 position, and the rolled paper Rp in contact with the rollers 18 can be fed by the feed roller 2. When feeding the cut paper Kp from the second accommodating part 9 of the feed tray 1, the flap 51 is set to the second position, and the cut paper Kp supported by the support surface 51*a* can be fed by the feed roller 2. Namely, the rolled paper Rp unrolled from the rolled body R in the first accommodating part 8 and the cut paper Kp in the second accommodating part 9 can be fed by the single feed roller 2 along the same route. Therefore, the size of the apparatus can be reduced.

In the printer 100 of the above embodiment, it is possible to nip the rolled paper Rp between the rollers 18 and the feed roller 2 and to convey the rolled paper Rp smoothly.

In the printer 100 of the embodiment described above, the support surface 51*a* of the flap 51 has the base pad 92. The coefficient of friction of the base pad 92 is greater than the coefficient of friction of the support surface 51*a*. When the flap 51 is in the second position, the portion, of the flap 51, where the base pad 92 is provided is located on the movement path of the feed roller 2. By providing the base pad 92 on the support surface 51*a*, it is possible to prevent a lowermost cut paper Kp among the cut paper Kp in the stacked state from moving, and to prevent feeding the cut papers Kp in a state of being overlapped with each other. In particular, when there are two sheets of the cut papers Kp on the support surface 51*a*, it is possible to prevent effectively feeding the two sheets of the cut papers Kp in the state of being overlapped with each other. When the area where the base pad 92 is provided is out of the movement path of the feed roller 2, there is a possibility that the cut papers Kp are fed in a state of being overlapped with each other (overlapping feed) or that the cut papers Kp may not be fed (blank feed). In this configuration, because the part where the base pad 92 is provided is located on the movement path of the feed roller 2, it is possible to prevent the overlapping feed and the blank feed, certainly.

In the printer 100 of the embodiment described above, when the flap 51 is in the second position, the flap 51 covers the contact portion, of the bottom surface 11*a*, where the feed roller 2 contacts. According to this configuration, even if the rolled paper Rp is accidentally fed into the feed path I when the flap 51 is in the second position, the feed roller 2 cannot feed the rolled paper Rp on the bottom surface 11*a* because the flap 51 covers the part, of the bottom surface 11*a*, where the feeding roller 2 contacts. Therefore, the rolled paper Rp cannot be fed out from the feed tray 1.

In the printer 100 of the embodiment described above, when the paper sheet presence/absence detecting unit 20 detects that the paper sheet P is placed on the feed position, controller 10 controls the feed roller 2 to feed the paper sheet P from the feed tray 1. When the flap 51 is in the second position, even if the cut paper Kp is not supported on the support surface 51*a* of the flap 51 and the rolled paper Rp is accidentally fed into the feed path I, the feed roller 2 contacts the support surface 51*a* of the flap 51. At this time, the paper sheet presence/absence detecting unit 20 does not detect that the paper sheet P is placed on the feed position. Therefore, the rolled paper Rp is not fed out from the feed tray 1 by feed roller 2.

In the feed tray 1 of the embodiment described above, the surface 51*b* opposite the support surface 51*a* of the flap 51 has the first protrusions 52. When the flap 51 is in the second position, the first protrusions 52 prevent the rolled paper Rp unrolled from the rolled body R accommodated in the first accommodating part 8 from proceeding toward the rollers 18 between the first accommodating part 8 and the rollers 18. When flap 51 is in the second position, even if the rolled paper Rp unrolled from the rolled body R accommodated in the first accommodating part 8 is accidentally Rp fed toward the rollers 18, the first protrusions 52 prevents the rolled paper Rp from being conveyed to the rollers 18. This prevents the rolled paper Rp from being accidentally fed out from the feed tray 1.

In the feed tray 1 of the embodiment described above, when the flap 51 is in the first position, the surface 51*b* having the first protrusions 52 faces upward. Therefore, with the flap 51 in the first position, if the cut papers Kp are accidentally placed on the surface 51*b* opposite to the support surface 51*a* of the flap 51, the first protrusions 52 will lift the cut papers Kp. Therefore, the user can easily notice the setting error.

In the feed tray 1 of the embodiment described above, the bottom surface 11*a* has the recesses 19*a* for receiving the first protrusions 52 of the flap 51 in the second position, and the tip end of each of the first protrusions 52 is chamfered. Therefore, when the flap 51 is moved from the first position to the second position, it is possible to prevent the first protrusions 52 from riding up on the bottom surface 11*a* of the feed tray 1.

In the feed tray 1 of the embodiment described above, the surface 51*b* opposite to the support surface 51*a* of the flap 51 has the second protrusions 53. The bottom wall 11 of the main body 16 has the abutment surface 19*b* facing upstream in the feed direction. The second protrusions 53 abut against the abutment surface 19*b* when the flap 51 is in the second position. When the cut paper Kp supported by the support surface 51*a* of the flap 51 is fed by the feed roller 2 from the feed tray 1, even if the force toward the downstream side of the feed direction is applied to the flap 51, the second protrusions 53 of the flap 51 abuts against the abutment surface 19*b* of the main body 16. This prevents a large force from being applied to the axes 71, 72, etc.

The feed tray 1 of the embodiment described above has the link member 61 via which the flap 51 is attached to the support plate 91. The link member 61 is positioned between the flap 51 and the support plate 91 in the feed direction when the flap 51 is in the second position. The upstream end in the feed direction of the link member 61 is attached to the support plate 91, such that the link member 61 can rotate about the axis 72 extending along the left-right direction. When the flap 51 is in the second position, the flap 51 is attached to the downstream end in the feed direction of the link member 61, such that the flap 51 is rotatable about the axis 71 extending along the left-right direction. The link member 61 is provided with the protruding portion 62. When the flap 51 rotates and moves from the second position to the first position, the protruding portion 62 interferes with the support plate 91, and prevent the angle between the bottom surface 11*a* of the feed tray 1 and the link member 61 from being 90 degrees or more. Therefore, when moving the flap 51 from the second position to the first position, the flap 51 can be reliably placed on the top surface of the support plate 91. In addition, since the angle between the bottom surface 11*a* of the feed tray 1 and the link member 61 is less than 90 degrees, the flap 51 can be placed in an appropriate position.

In the feed tray 1 of the embodiment described above, the link member 61 is the plate-shaped member which is long in the left-right direction. One end in the short direction of the link member 61 is attached to the support plate 91. The other end in the short direction of the link member 61 is attached to the central part in the left-right direction of the flap 51. The right end at the other end in the short direction of the link member 61 has the protruding portion 62 protruding to the right. Thus, the length of the other end in the short direction of the link member 61 is longer than the length in the short direction of the one end of the link member 61. Therefore, when attaching the link member 61 to the support plate 91 and the flap 51, it is possible to prevent the one end in the short direction from being attached to the flap 51 and the other end in the short direction from being attached to the support plate 91. Also, when attaching the link member 61 to the support plate 91 and the flap 51, if the front and back surfaces of the link member 61 are opposite each other, the protruding portion 62 is located at the left end. Therefore, the position of the flap 51 attached to the other end of the link member 61 is shifted to the left. Thus, the user can easily notice that the front and back surfaces of the link member 61 are opposite to each other.

In the feed tray 1 of the embodiment described above, the notch 91*b* is formed in the downstream end in the feed direction of the support plate 91, and the flap 51 is attached to the inside of the notch 91*b* of the support plate 91. Since the support plate 91 is located on both sides in the left-right direction of the flap 51, the lift of the rolled paper Rp supported by the bottom surface 11*a* of the feeding tray 1 can be suppressed by the support plate 91.

The feed tray 1 of the embodiment described above is provided with the separation strip 31. The separation strip 31 contacts the cut paper Kp fed from the second accommodating part 9 by the feed roller 2 and separates the cut paper Kp which the feed roller 2 contacts from the other cut papers Kp. When the flap 51 is in the second position, the flap 51 extends downstream in the feed direction from the movement path of the feed roller 2. Therefore, the support surface 51*a* of the flap 51 supports the cut paper Kp and maintain the posture of the cut paper Kp even downstream in the feed direction from the movement path of the feed roller 2. Therefore, the cut paper Kp can be securely separated by the separation strip 31. A curl of the rolled paper Rp supported by the bottom surface 11*a* can be suppressed by the flap 51 to the feed position.

In the feed tray 1 of the embodiment described above, the support plate 91 has the support portion 91*c* which supports the flap 51 in the second position from below. The support plate 91 is configured to be rotatable around the rotation axis 91*a* extending along the left-right direction. Accordingly, when the support plate 91 is rotated around the rotation axis 91*a*, the flap 51 supported by the support portion 91*c* also rotates together with the support plate 91.

The above description of the embodiment of the present teaching is based on the drawings, but the specific configurations should not be considered limited to the embodiment. The scope of the teaching is depicted by the claims, not by the description of the above embodiment, and further includes all modifications within the meaning and scope equivalent to the claims.

In the embodiment described above, the bottom surface 11*a* of the feed tray 1 is provided with rollers 18 at the portion where the feed roller 2 contacts. However, the rollers 18 may not be provided, and the feed roller 2 may contact the bottom surface 11*a* directly. In place of the rollers 18, a base pad or a roller having a coefficient of friction smaller than that of the bottom surface 11*a* may be provided.

In the embodiment described above, the support surface 51*a* of the flap 51 is provided with the base pad 92 having the coefficient of friction greater than the coefficient of friction of the support surface 51*a*. The base pad 92 is located on the movement path of the feed roller 2 when the flap 51 is in the second position. However, the present teaching is not limited to this, and the base pad 92 may be provided at a position out of the movement path of the feed roller 2 when the flap 51 is in the second position. Furthermore, instead of the base pad 92, an area with a higher coefficient of friction than other area of the support surface 51*a* may be provided by processing the support surface 51*a*. The support surface 51*a* may not be provided with areas having different coefficients of friction.

In the embodiment described above, when the paper sheet presence/absence detecting unit 20 detects that paper sheet P is placed in the feed position, the controller 10 controls feed roller 2 to feed the paper sheet P from feed tray 1. However, the present teaching is not limited to this. That is, the paper sheet presence/absence detecting unit 20 may not be provided.

Figure 12A:
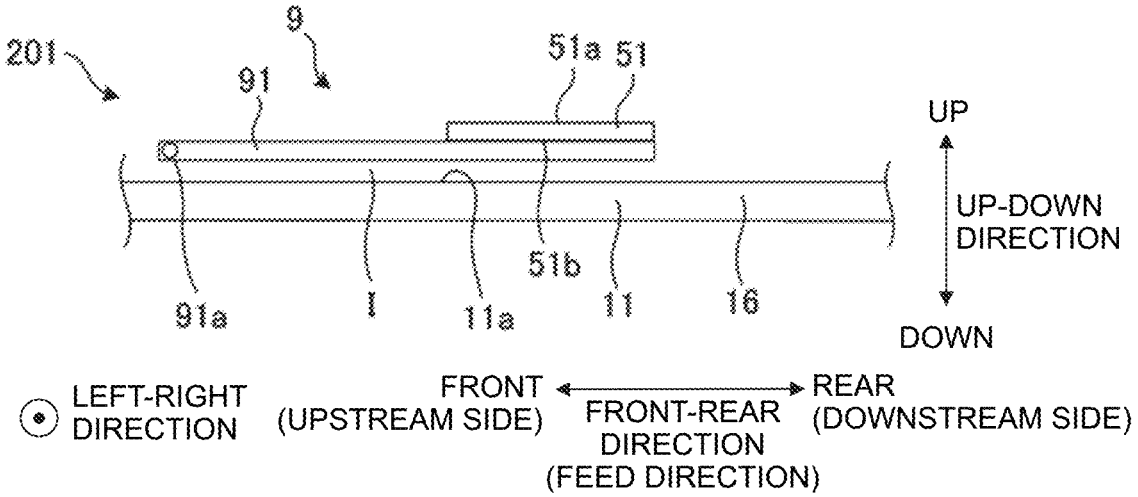
FIGS. 12A and 12B depict a feed tray according to a modification of the embodiment.
Figure 12B:
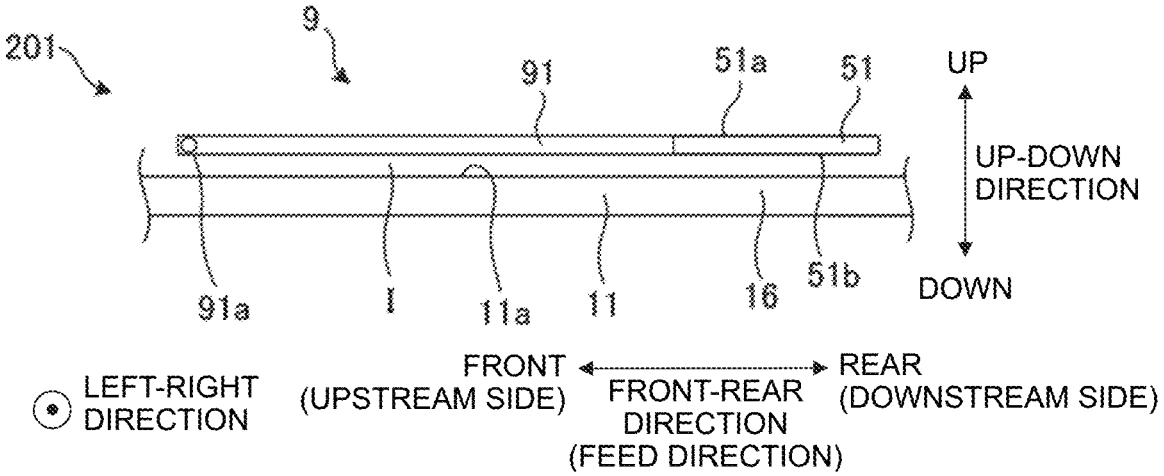

In the embodiment described above, the flap 51 is provided as a support member with a support surface for supporting the cut papers Kp accommodated in the second accommodating part 9. The flap 51 rotates around the axis 71 extending along the left-right direction to move between the first position in which the flap 51 is evacuated from (out of) the movement path of the feed roller 2 and the second position in which the flap 51 is on the movement path of the feed roller 2 with the support surface 51*a* facing upward. However, the present teaching is not limited to this. For example, in the feed tray 201 depicted in FIGS. 12*a* and 12*b*, the support member 51 is configured to slide along the feed direction. When the support member 51 is in the first position where the support member 51 is evacuated from the movement path of the feed roller 2 as depicted in FIG. 12A, and when the support member 51 is in the second position on the movement path of the feed roller 2 as depicted in FIG. 12B, the support surface 51*a* faces upward. Furthermore, although not depicted in the drawings, the support member may be configured to be removable from the feed tray 1. In this case, by removing the support member from the feed tray 1, the support member can be evacuated from the movement path of the feed roller 2.

In the embodiment described above, the surface 51*b* of the flap 51 is provided with the first protrusions 52. The first protrusions 52 are received in the recesses 19*a* formed in the bottom surface 11*a* of the feed tray 1, when the flap 51 is in the second position. However, the present teaching is not limited to this. For example, the recesses 19*a* may not be formed in the bottom surface 11*a* of the feed tray 1, and the first protrusions 52 may contact the bottom surface 11*a* when the flap 51 is in the second position.

Although the tips of the first protrusions 52 are chamfered in the embodiment described above, the tips of the first protrusions 52 may not be chamfered.

In the embodiment described above, the surface 51*b* of the flap 51 has second protrusions 53 which contact the abutment surfaces 19*b* of the main body 16 when the flap 51 is in the second position. However, the second protrusions 53 and the abutment surface 19*b* may not be provided.

In the embodiment described above, the flap 51 is attached to the support plate 91 via the link member 61. However, the flap 51 may be directly attached to the supporting plate 91 without any other member.

In the embodiment described above, the link member 61 has the protruding portion 62. However, the link member 61 may not have the protruding portion 62.

In the embodiment described above, a notch 91*b* is formed at the downstream end in the feed direction of the support plate 91, and the flap 51 is attached to the inside of the notch 91*b* of the support plate 91. However, the present teaching is not limited to this. For example, the notch 91*b* may not be formed in the support plate 91, and the flap 51 may be attached to the downstream end in the feed direction of the support plate 91.

In the embodiment described above, when the flap 51 is in the second position, the flap 51 extends further downstream in the feed direction than the movement path of the feed roller 2. However, the present teaching is not limited to this. For example, the downstream end in the feed direction of the flap 51 in the second position may be located on the movement path of the feed roller 2.

In the embodiment described above, the support plate 91 has the support portion 91*c* supporting the flap 51 from below, and the support plate 91 is configured to be rotatable around the rotation axis 91*a* extending along the left-right direction. However, the present teaching is not limited to this. For example, the support plate 91 may not have the support portion 91*c*. Further, the support plate 91 may not be rotatable around the rotation axis 91*a*.

The present teaching can be applied to all image recording apparatuses provided with a feed tray which can accommodate a rolled body R and cut papers Kp. In other words, the present teaching can be applied not only to an inkjet printer provided with a head, which ejects ink from nozzles, as a recording unit, but also to a laser-type printer where an electrostatic latent image is formed by exposing a photosensitive material with a laser, or to an electrophotographic printer equipped with an LED-type recording section where an electrostatic latent image is formed by exposing a photosensitive material with a LED. The sheet media is not limited to the paper, but can also be a cloth or other resin material such as a film and the like, as long as having a sheet form.

What is claimed is:

1. An image recording apparatus, comprising:

a feed tray;

a feed roller configured to feed a sheet medium accommodated in the feed tray; and a recording unit configured to record an image on the sheet medium fed by the feed roller, wherein the feed tray includes:

a first accommodating part configured to accommodate a rolled body formed by rolling the sheet medium;

a second accommodating part configured to accommodate a plurality of sheet media in a stacked state, each of the sheet media being the sheet medium;

a contact surface configured to contact, from below, the sheet medium unrolled from the rolled body accommodated in the first accommodating part; and a support member having a support surface configured to support the plurality of sheet media in the stacked state, which is accommodated in the second accommodating part, in a state where the second accommodating part is in a posture to accommodate the plurality of sheet media in the stacked state, a position of the second accommodating part relative to the first accommodating part is fixed, the feed roller is configured to be movable between a contact position at which the feed roller contacts the contact surface and a separation position at which the feed roller is away from the contact surface, and the support member is configured to be movable between a first position at which the support member is outside a movement path of the feed roller and a second position at which the support member is on the movement path of the feed roller with the support surface facing upward.

2. The image recording apparatus according to claim 1, wherein the feed tray further includes a roller having the contact surface.

3. An image recording apparatus comprising:

a feed tray;

a feed roller configured to feed a sheet medium accommodated in the feed tray; and a recording unit configured to record an image on the sheet medium fed by the feed roller, wherein the feed tray includes:

a first accommodating part configured to accommodate a rolled body formed by rolling the sheet medium;

a second accommodating part configured to accommodate a plurality of sheet media in a stacked state, each of the sheet media being the sheet medium;

a contact surface configured to contact, from below, the sheet medium unrolled from the rolled body accommodated in the first accommodating part;

a support member having a support surface configured to support the sheet media accommodated in the second accommodating part, and a roller having the contact surface, the feed roller is configured to be movable between a contact position at which the feed roller contacts the contact surface and a separation position at which the feed roller is away from the contact surface, the support member is configured to be movable between a first position at which the support member is outside a movement path of the feed roller and a second position at which the support member is on the movement path of the feed roller with the support surface facing upward, the support surface includes a first area and a second area having a coefficient of friction higher than a coefficient of friction of the first area, and in a state that the support member is positioned at the second position, the second area is positioned on the movement path of the feed roller.

4. The image recording apparatus according to claim 1, wherein in the second position, the support member covers a contact part, of the contact surface, at which the feed roller contacts the contact surface.

5. The image recording apparatus according to claim 1, further comprising:

a controller; and a detecting unit configured to detect whether the sheet medium is placed at a feed position at which the sheet medium is fed by the feed roller, wherein in a case that the detecting unit detects that the sheet medium is placed at the feed position, the controller is configured to control the feed roller to feed the sheet medium from the feed tray.

6. An image recording apparatus comprising:

a feed tray;

a feed roller configured to feed a sheet medium accommodated in the feed tray; and a recording unit configured to record an image on the sheet medium fed by the feed roller, wherein the feed tray includes:

a first accommodating part configured to accommodate a rolled body formed by rolling the sheet medium;

a second accommodating part configured to accommodate a plurality of sheet media in a stacked state, each of the sheet media being the sheet medium;

a contact surface configured to contact, from below, the sheet medium unrolled from the rolled body accommodated in the first accommodating part; and a support member having a support surface configured to support the sheet media accommodated in the second accommodating part, the feed roller is configured to be movable between a contact position at which the feed roller contacts the contact surface and a separation position at which the feed roller is away from the contact surface, the support member is configured to be movable between a first position at which the support member is outside a movement path of the feed roller and a second position at which the support member is on the movement path of the feed roller with the support surface facing upward, and the support member is a plate member with one side as the support surface, and moves between the first position and the second position by rotating around a first axis extending in one direction in a plane parallel to the support surface.

7. The image recording apparatus according to claim 6, wherein the feed tray further includes a partitioning member configured to partition a space in the feed tray into an upper space and a lower space, the first axis is parallel to a horizontal direction and extends in a first direction orthogonal to a feed direction of the sheet medium by the feed roller, the support member has a base end, at which the first axis is located, at an upstream end in the feed direction in a state of the support member being in the second position, and the base end of the support member is attached to a downstream end in the feed direction of the partitioning member.

8. The image recording apparatus according to claim 7, wherein the support member has a first protrusion formed on the other side opposite to the one side, and in the state of the support member being in the second position, the first protrusion is arranged at a position between the first accommodating part and a contact part, of the contact surface, at which the feed roller contacts the contact surface, such that the first protrusion prevents the sheet medium unrolled from the rolled body from proceeding toward the contact part.

9. The image recording apparatus according to claim 8, wherein the other side of the support member faces upward in a state of the support member being in the first position.

10. The image recording apparatus according to claim 8, wherein the contact surface has a recess configured to receive the first protrusion of the support member in the second position, and a tip end of the first protrusion is chamfered.

11. The image recording apparatus according to claim 7, wherein the feed tray further includes a main body, the support member has a second protrusion formed on the other side opposite to the one side, and the main body has an abutment surface which faces upstream side in the feed direction such that the second protrusion abuts against the abutment surface in the state of the support member being in the second position.

12. The image recording apparatus according to claim 7, wherein the support member is on an upper surface of the partitioning member in a state of the support member being in the first position.

13. The image recording apparatus according to claim 12, wherein the feed tray further includes a link member via which the support member is attached to the partitioning member, in the state of the support member being in the second position, the link member is arranged between the support member and the partitioning member in the feed direction, and an upstream end in the feed direction of the link member is attached to the partitioning member such that the link member rotates around a second axis extending in the first direction, in the state of the support member being in the second position, the support member is attached to a downstream end in the feed direction of the link member such that the support member rotates around the first axis, and the link member includes a regulating part configured to interfere with the support member to prevent an angle between the contact surface and the link member from being 90 degrees or more under a condition that the support member moves from the second position to the first position by rotating.

14. The image recording apparatus according to claim 13, wherein the link member is a plate member long in the first direction, one end in a short direction of the link member is attached to the partitioning member and the other end in the short direction of the link member is attached to a central part in the first direction of the support member, and the link member has a protruding portion protruding in the first direction, at one end in the first direction of the other end in the short direction.

15. The image recording apparatus according to claim 7, wherein the partitioning member is formed with a notch at the downstream end in the feed direction, and the support member is attached to an inside of the notch of the partitioning member.

16. The image recording apparatus according to claim 7, further comprising a separation strip configured to contact the sheet medium fed from the second accommodating part by the feed roller to separate the sheet medium contacting the feed roller from other sheet media accommodated in the second accommodating part, wherein in the state of the support member being in the second position, the support member extends to a downstream side in the feed direction with respect to the movement path of the feed roller.

17. The image recording apparatus according to claim 7, wherein the partitioning member has a support portion configured to support the member, and the partitioning member is configured to rotate around a third axis extending along the first direction.

18. A feed tray, comprising;

a first accommodating part configured to accommodate a rolled body formed by rolling sheet medium;

a second accommodating part configured to accommodate a plurality of sheet media in a stacked state, each of the sheet media being the sheet medium;

a contact surface configured to contact, from below, the sheet medium unrolled from the rolled body accommodated in the first accommodating part; and a support member having a support surface configured to support the plurality of sheet media in the stacked state, which is accommodated in the second accommodating part, wherein in a state where the second accommodating part is in a posture to accommodate the plurality of sheet media in the stacked state, a position of the second accommodating part relative to the first accommodating part is fixed, and the support member is configured to be movable between a cover position at which the support member covers a part of the contact surface with the support surface facing upward and a separation position at which the support member is farther from the part of the contact surface as compared with the cover position.

19. The image recording apparatus according to claim 1, further comprising a housing, wherein during recording by the recording unit, the first accommodating part is located inside the housing.

* * * * *